US009303939B1

(12) United States Patent
Brinkmeyer et al.

(10) Patent No.: US 9,303,939 B1
(45) Date of Patent: Apr. 5, 2016

(54) TUNABLE MUZZLE BRAKE

(71) Applicant: AR1510 LLC, Geneseo, IL (US)

(72) Inventors: Nathan A. Brinkmeyer, Davenport, IA (US); Thomas L. Thacker, II, Geneseo, IL (US)

(73) Assignee: AR1510 LLC, Geneseo, IL (US)

( * ) Notice: Subject to any disclaimer, the term of this patent is extended or adjusted under 35 U.S.C. 154(b) by 0 days.

(21) Appl. No.: 14/718,227

(22) Filed: May 21, 2015

(51) Int. Cl.
*F41A 21/38* (2006.01)

(52) U.S. Cl.
CPC ..... *F41A 21/38* (2013.01)

(58) Field of Classification Search
CPC ..... F41A 21/36; F41A 21/38
USPC ..... 89/14.2–14.4; 181/223
See application file for complete search history.

(56) References Cited

U.S. PATENT DOCUMENTS

| | | | | | |
|---|---|---|---|---|---|
| 812,140 | A * | 2/1906 | Kent | F41A 21/28 | 89/14.3 |
| 2,791,940 | A | 5/1957 | Speake et al. | | |
| 2,842,024 | A * | 7/1958 | Mutter | F41A 21/28 | 42/76.01 |
| 3,710,679 | A * | 1/1973 | Werbell, III | F41A 21/30 | 89/14.4 |
| 3,952,629 | A * | 4/1976 | Boccarossa | F41A 21/30 | 89/14.4 |
| 4,126,077 | A | 11/1978 | Quesnel | | |
| 4,869,151 | A * | 9/1989 | Chahin | F41A 21/36 | 181/223 |
| 5,320,022 | A * | 6/1994 | Kimbro | F41A 21/36 | 89/14.3 |
| 5,333,529 | A | 8/1994 | Brockman | | |
| 5,425,298 | A | 6/1995 | Coburn | | |
| 5,811,713 | A | 9/1998 | Gudgel | | |
| 5,844,162 | A | 12/1998 | Renner | | |
| 6,308,609 | B1 * | 10/2001 | Davies | F41A 21/30 | 181/223 |
| 7,228,778 | B2 | 6/2007 | Edwards et al. | | |

OTHER PUBLICATIONS

Lancer Systems, Rifle Accessories & Components web page, www.lancer-systems.com, Dec. 22, 2014.
Rubber City Armory, 5.56 Tunable Muzzle Brake (556-TMB), www.rubbercityarmory.com/scripts/prodview, Dec. 22, 2014.

* cited by examiner

*Primary Examiner* — Reginald Tillman, Jr.
(74) *Attorney, Agent, or Firm* — Woodard, Emhardt, Moriarty, McNett & Henry LLP

(57) ABSTRACT

The present disclosure provides, in part, new muzzle brakes, kits, and weapons systems (e.g., rifles) that allow for incremental adjustment of the ports of a muzzle brake so that the muzzle brake can be tuned for the user and firearm system. In certain aspects, the present disclosure provides muzzle brake plugs having an interior surface defining a plug bore that extends at least partially through the thickness of the muzzle brake plug and muzzle brakes having a plurality of side ports extending laterally away from a central bore and arranged to replaceably receive muzzle brake plugs. A bottom wall closing the plug bore of a muzzle brake plug can be selectively drilled or punch-out to create or enlarge an opening with the plug bore, thus allowing a shooter to tune the muzzle brake to the firearm system.

20 Claims, 4 Drawing Sheets

TUNABLE MUZZLE BRAKE

BACKGROUND

The present disclosure pertains generally to firearms. In particular, the present disclosure provides muzzle brakes for firearms.

It is advantageous in shooting a firearm, especially in fast action competitions, that the muzzle of the firearm remains as stable as possible during firing to allow for faster follow-up shots. Unfortunately, during normal offhand firing, a firearm muzzle may move (e.g., rise) after a shot. Many times, these movements are the result of the line of recoil in a firearm being offset from location(s) where the firearm is supported (e.g., the buttstock), and generally result in the firearm moving in the direction of the least amount of support. However, these movements can also be caused due to the shooter's trigger squeeze. For example, if the shooter is right-handed the muzzle may move to the right (from the perspective of the shooter), and if the shooter is left-handed it may move to the left due to the shooter's finger pulling the trigger to the side.

To help stabilize the muzzle of the firearm during firing, the firearm may include a muzzle brake. In general, a muzzle brake is a device coupled to the muzzle end of a firearm's barrel that directs propellant gases to counteract movement(s) of the barrel that occur during firing. A muzzle brake has an opening through the center, called the bore, in which the bullet passes as a cartridge is fired. Extending transverse to the bore are one or more permanent openings (e.g., ports) in communication with the bore that allow propellant gases from inside the bore to escape laterally from one or more sides of the muzzle brake. These openings can be perpendicular to the bore or at a variety of angles and are what make the brake effective at catching the expanding gases in order to compensate for the recoil of the firearm. For example, the muzzle brake may direct propellant gases generally rearward (i.e., toward the shooter) to reduce the felt recoil upon firing. Alternatively or additionally, the muzzle brake may direct gases towards one or more sides of the barrel to counteract the rising of the barrel and/or left or right drift.

While muzzle brakes exist, there is a desire for new designs.

SUMMARY

The present disclosure can be particularly useful for precision shooting where remaining on target can allow the shooter to watch the impact of the bullet on target and/or fire another bullet at the target without having to reaim the weapon. The present disclosure provides, in part, new muzzle brakes, kits, and weapons systems (e.g., rifles) that allow for incremental adjustment of the ports of a muzzle brake so that the muzzle brake can be tuned for the user and firearm system.

In certain aspects, the present disclosure provides novel muzzle brake plugs that are positionable within side ports of a muzzle brake. The muzzle brake plugs may include a bore that extends at least partially through the thickness of the muzzle brake plug. In the illustrated embodiment, the bore of the muzzle brake plug has a closed bottom formed by a bottom wall of the muzzle brake plug that can be selectively drilled or punched-out to create an opening of desired size (e.g., diameter and/or cross-sectional dimension). In many instances, the bottom wall has a thickness that is less than the thickness of a sidewall of the muzzle brake plug. Additionally, the muzzle brake plug may have one or more tapered surfaces arranged to center a drill bit within the brake plug.

The amount of gas flow moving through the ports and the amount of pressure generated by the shot dictates how much compensation force is generated by the muzzle brake. A wide variety of shapes and sizes of ports on the muzzle brake device with which to catch the expanding gases that follow the bullet are contemplated, with larger openings (e.g., circular openings having a larger diameter) in the muzzle brake plugs and the muzzle brakes being generally preferred to generate a greater compensation force. Similarly, a wide variety of shapes and sizes of muzzle brake plugs and plug bores are contemplated. The ports and/or plug bores may also be arranged to extend at an acute angle relative to the central bore of the muzzle brake (i.e., towards or away from the shooter). In some instances, the plug bores of the disclosed muzzle brake plugs may have threads arranged to receive a set screw so that the plug bore of the muzzle brake plug may be selectively opened and closed.

Turning now to a discussion of the muzzle brakes, some muzzle brakes of the present disclosure comprise a muzzle brake body having a rearward portion and a forward portion and a length extending from the rearward portion to the forward portion; wherein the rearward portion is arranged to couple to a muzzle end of a firearm barrel; wherein the muzzle brake body defines a central bore and a plurality of side ports communicating with the central bore; wherein the central bore extends through the length of the muzzle brake body; wherein a first side port of the plurality of side ports is a threaded side port and is arranged to replaceably receive a threaded muzzle brake plug; and wherein side ports positioned forward of the first side port are larger than said first side port. In some instances, the plurality of side ports includes second and third side ports arranged to replaceably receive muzzle brake plugs; and the first, second, and third side ports are positioned on the right, top, and left sides of the muzzle brake. Additionally or alternatively, the side ports positioned forward of the first side port are free of threads.

The present disclosure also provides kits comprising a muzzle brake, and a muzzle brake plug; wherein the muzzle brake is arranged to couple to a muzzle end of a firearm barrel and defines a central bore and a first side port, the central bore extending through the muzzle brake and the first side port communicating with the central bore and the first side port arranged to replaceably receive the muzzle brake plug; and wherein the muzzle brake plug has an exterior surface, an interior surface and a thickness, the interior surface defining a plug bore that extends at least partially through the thickness of the muzzle brake plug. In some arrangements, the muzzle brake defines second and third side ports arranged to replaceably receive muzzle brake plugs; and the first, second, and third side ports are positioned on the right, top, and left sides of the muzzle brake. Furthermore, in some instances, the muzzle brake defines a fourth side port positioned forward of the first side port and communicating with the central bore of the muzzle brake, and optionally the first side port is a threaded side port and the muzzle brake plug is a threaded muzzle brake plug so that it may be threadably received within the threaded side port; and the fourth side port is free of threads. The fourth side port can be larger than the first side port, and the muzzle brake plugs can have a closed and tapered bottom. The kits can also include a firearm barrel receivable within the rearward portion of the muzzle brake and/or an upper receiver attachable to the barrel; and a bolt carrier group receivable within the upper receiver.

The present disclosure also provides weapon systems, such as rifles, comprising an upper assembly; and a lower assembly; the upper assembly including an upper receiver, a barrel assembly, and a bolt carrier group; the lower assembly including a lower receiver, a grip (e.g., a pistol grip), a trigger assembly, and a buttstock; the barrel assembly including a barrel, a muzzle brake, and at least one muzzle brake plug; wherein the muzzle brake is attached on a muzzle end of a firearm barrel and defines a central bore and a first side port, the central bore extending through the muzzle brake and the first side port communicating with the central bore and the first side port being threaded and arranged to replaceably receive the muzzle brake plug; and wherein the muzzle brake plug has a threaded exterior surface corresponding to the threaded first side port, an interior surface and a thickness, the interior surface defining a plug bore that extends at least partially through the thickness of the muzzle brake plug. In some instances, the muzzle brake defines second and third threaded side ports arranged to replaceably receive muzzle brake plugs; and the first, second, and third threaded side ports are positioned on the right, top, and left sides of the muzzle brake. Additionally or alternatively, the muzzle brake can define a fourth side port positioned forward of the first side port and communicating with the central bore of the muzzle brake; wherein the fourth side port is free of a threaded surface.

With a threaded side port or plug bore that is blocked by a solid screw, propellant gases are either allowed to pass when the screw is removed, or propellant gases are blocked when the screw is inserted, thus the compensation force is either "off" or "full". With a variable size plug opening, such as one that is drilled into the muzzle brake plug, the correctional force can be tuned by gradually increasing the size (e.g., cross-sectional dimension of the opening) until the desired amount of force is applied.

Of course, once material is removed from the muzzle brake plug it cannot practically be replaced; however, the muzzle brake plugs and muzzle brake arrangements disclosed herein allow a user to remove a drilled muzzle brake plug and replace it with a new muzzle brake or a muzzle brake plug with a smaller opening in the bottom wall of the muzzle brake plug. Therefore, should a user drill too large of an opening in the muzzle brake plug, causing over-compensation during firing of the weapon, the over-drilled muzzle brake plug may be removed and replaced with a new muzzle brake plug. Advantageously, this arrangement allows for a shooter familiar with basic hand tools to tune/adjust his/her own muzzle brake without the need of a gun smith or risking over-drilling the permanent openings in the muzzle brake.

Furthermore, the amount of pressure generated at each port, and therefore the force applied in each direction, can vary significantly with changes in the firearm system. The firearm system consists of the firearm itself, ammunition, and any ancillary devices attached to the firearm. Advantageously, the disclosed muzzle brake plugs and muzzle brake arrangements allow a user to selectively replace individual muzzle brake plugs to tune the firearm system in response to changes to the firearm system. For example, should a user change the ammunition being used in the firearm, the shooter may selectively replace one or more muzzle brake plugs with ones that have been tuned for that particular ammunition.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
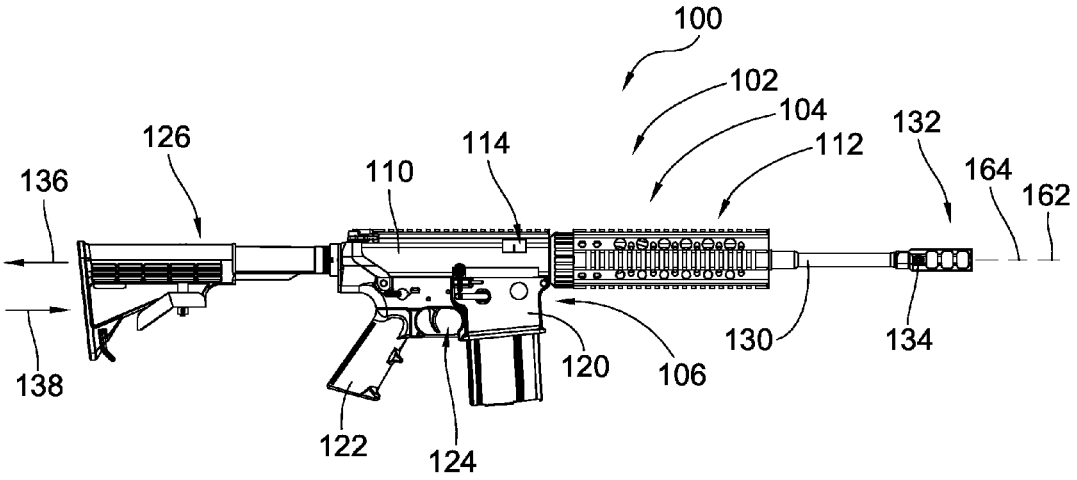
FIG. 1 is a side view of a weapon system.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

It is advantageous in shooting a firearm, especially in fast action competitions, that the muzzle of the firearm remains as stable as possible during firing to allow for faster follow-up shots. Unfortunately, during normal offhand firing, a firearm muzzle may move (e.g., rise) after a shot. Many times, these movements are the result of the line of recoil in a firearm being offset from location(s) where the firearm is supported (e.g., the buttstock), and generally result in the firearm moving in the direction of the least amount of support. However, these movements can also be caused due to the shooter's trigger squeeze. For example, if the shooter is right-handed the muzzle may move to the right (from the perspective of the shooter), and if the shooter is left-handed it may move to the left due to the shooter's finger pulling the trigger to the side.

To help stabilize the muzzle of the firearm during firing, the firearm may include a muzzle brake. In general, a muzzle brake is a device coupled to the muzzle end of a firearm's barrel that directs propellant gases to counteract movement(s) of the barrel that occur during firing. A muzzle brake has an opening through the center, called the bore, in which the bullet passes as a cartridge is fired. Extending transverse to the bore are one or more ports (e.g., openings) in communication with the bore that allow propellant gases from inside the bore to escape laterally from one or more sides of the muzzle brake. These ports can be perpendicular to the bore or at a variety of angles and are what make the brake effective at catching the expanding gases in order to compensate for the recoil of the firearm. For example, the muzzle brake may direct propellant gases generally rearward (i.e., toward the shooter) to reduce the felt recoil upon firing. Alternatively or additionally, the muzzle brake may direct gases towards one or more sides of the barrel to counteract the rising of the barrel and/or left or right drift.

While muzzle brakes exist, there is a desire for new designs. The present disclosure provides, in part, new muzzle brake assemblies, kits, and weapon systems (e.g., rifles) that allow for incremental adjustment of openings in the side ports of the muzzle brake so that the muzzle brake can be tuned for the user and weapon system. In certain aspects, the present disclosure provides novel muzzle brake plugs that are positionable within side ports of a muzzle brake. The muzzle brake plugs include a plug bore that extends at least partially through the thickness of the muzzle brake plug. In the illustrated embodiment, the bore of the muzzle brake plug has a closed bottom formed by a bottom wall of the muzzle brake plug that can be selectively drilled or punched-out to create an opening of desired size. In many instances, the bottom wall has a thickness that is less than the thickness of a sidewall of the muzzle brake plug. Additionally, the muzzle brake plug bore may have one or more tapered surfaces arranged to center a drill bit within the brake plug.

Arrangements disclosed herein allow the shooter to modify the effective size of ports, such as by increasing the size of the plug bore or an opening in the bottom end of the muzzle brake plug that communicates with the plug bore, in order to increase the amount of propellant gases that can escape laterally from a side of the muzzle brake. Advantageously, this can allow a shooter to specifically tune the muzzle brake to the firearm and ammunition being used. Furthermore, the muzzle brakes of the present disclosure can be "tuned" for a particular weapon system, ammunition, and/or shooter and then "retuned" if the weapon system, ammunition, and/or shooter changes or if a shooter desires a different compensation from the muzzle brake. To "retune" the muzzle brake, the user can selectively modify or replace the muzzle brake plugs of the muzzle brake and repeat the tuning process without modifying the body of the muzzle brake. Additionally, such modifications can be made with the muzzle brake attached to the weapon (e.g., without having to remove the muzzle brake from the weapon). Advantageously, this arrangement can decrease the cost and time associated with making changes to the firearm system and eases the tuning process.

FIG. 1 illustrates a weapon system 100 with an exemplary muzzle brake of the present disclosure. Weapon system 100 is a rifle 102 comprising an upper assembly 104 and a lower assembly 106. The upper assembly 104 includes an upper receiver 110, a barrel assembly 112, and a bolt carrier group 114. The lower assembly 106 includes a lower receiver 120, a grip 122, a trigger assembly 124, and a buttstock 126. The barrel assembly 112 of the upper assembly 104 includes a barrel 130, a muzzle brake 132, and at least one muzzle brake plug 134.

As discussed above, during normal offhand firing, a firearm muzzle may move (e.g., rise) after a shot. These movements are many times the result of the recoil force 136 being offset from the counter force 138 applied by the shooter's body. Since these forces are offset from one another, the resulting force includes a moment (i.e., rotational force) about the buttstock of the weapon system that causes the muzzle of the weapon system to rise.

Figure 2:
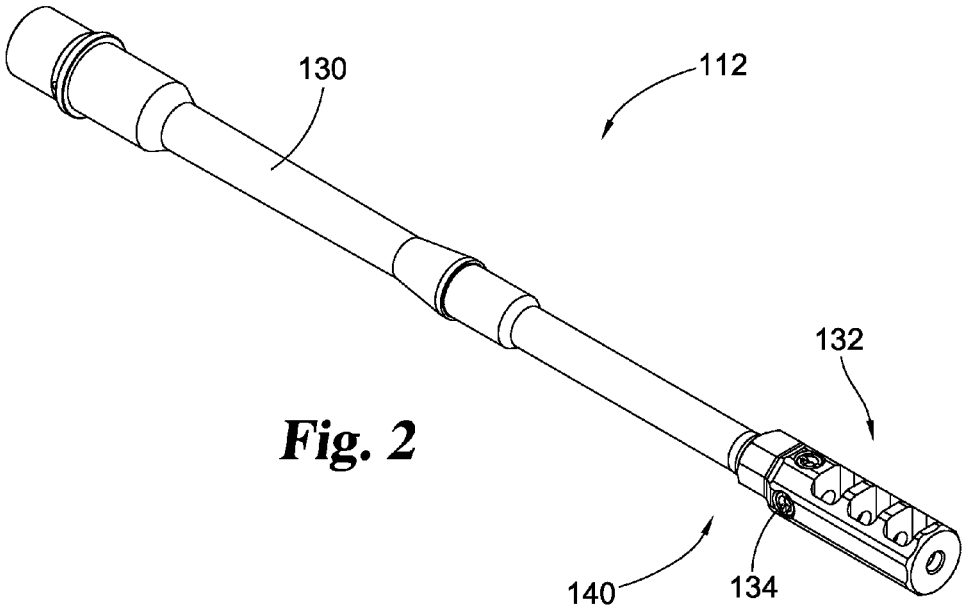
FIG. 2 is a perspective view of a barrel assembly.

FIG. 2 illustrates a perspective of the barrel assembly 112 of FIG. 1. As can be seen, muzzle brake 132 is mounted to the muzzle end 140 of the barrel 130. In some instances, muzzle brake 132 is permanently affixed to barrel 130, such as by being pinned, welded, press-fit and/or any combination of these to the end of barrel 130. Alternatively, muzzle brake 132 may be removeably attached to barrel 130, such as by a threaded attachment.

Figure 3:
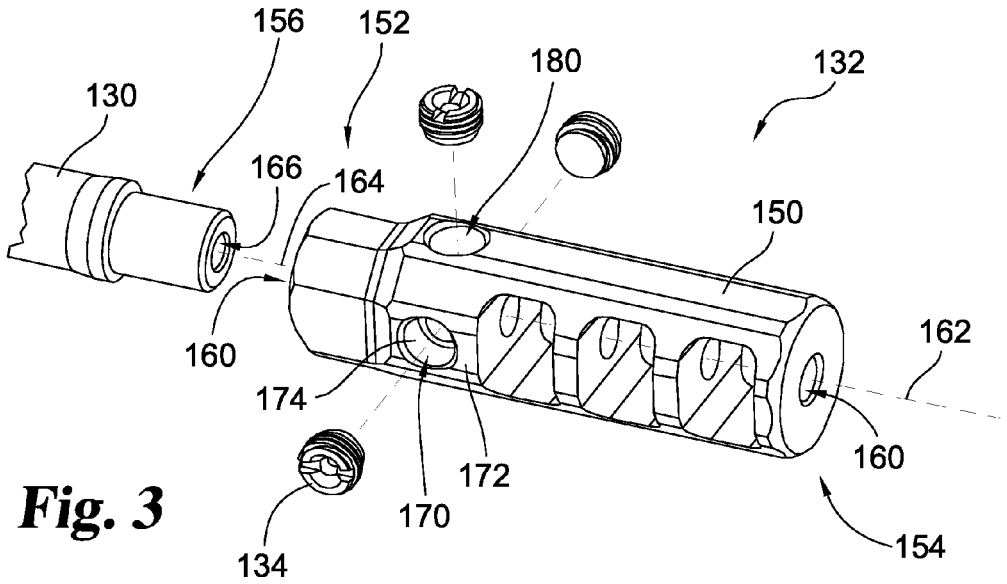
FIG. 3 is an exploded view of the muzzle end of the barrel assembly of FIG. 2.

FIG. 3 illustrates an exploded view of the muzzle end of barrel assembly 112. Muzzle brake 132 comprises a muzzle brake body 150 having a rearward portion 152, a forward portion 154 and a length extending from rearward portion 150 to forward portion 152. Rearward portion 152 of muzzle brake body 150 is arranged to couple to (e.g., receive) a muzzle end 156 of a barrel 130.

Muzzle brake body 150 defines a central bore 160 that extends through the length of muzzle brake body 150. Central bore 160 has a longitudinal axis 162 that is axially aligned with a longitudinal axis 164 of a barrel bore 166 of barrel 130 so that when a bullet is fired from the weapon system, the bullet may travel through barrel bore 162 and through central bore 160 and out of the muzzle end of the weapon system.

Muzzle brake body 150 defines a plurality of side ports including a first side port 170 in communication with central bore 160. First side port has a depth extending from central bore 160 towards an outer surface 172 of muzzle brake body 150. First side port 170 extends transverse to central bore 160 and is arranged to direct propellant gases from inside central bore 160 laterally to a side of muzzle brake 132. In many instances, first side port 170 has a wall 174 that is threaded so that the side port is a threaded side port and can threadably receive a threaded muzzle brake plug 134. Advantageously, the threaded coupling between muzzle brake body 150 and muzzle brake plug 134 allows muzzle brake plug 134 to be removable and replaceable so that a different muzzle brake plug 134 may be inserted within the side port should the first muzzle brake plug become fouled or have an undesirable opening size.

Figure 6:
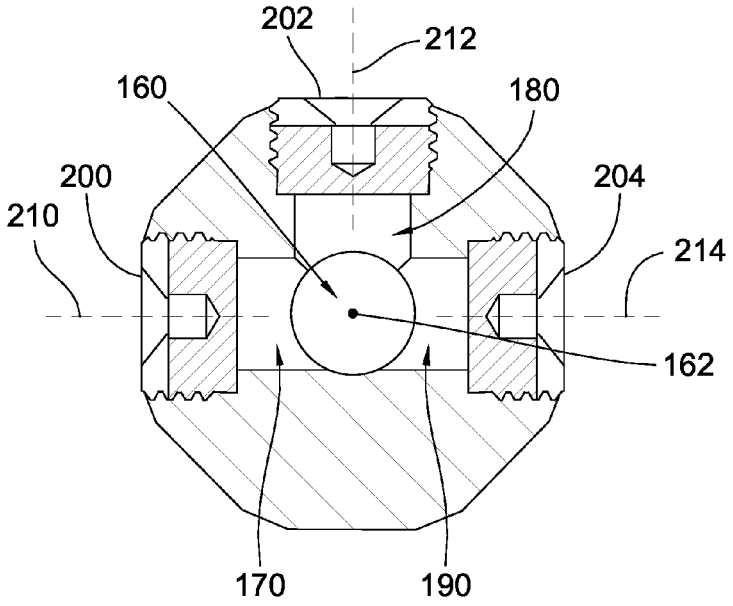
FIG. 6 is a cross-sectional view along line 6-6 of the muzzle brake of FIG. 4.
Figure 7:
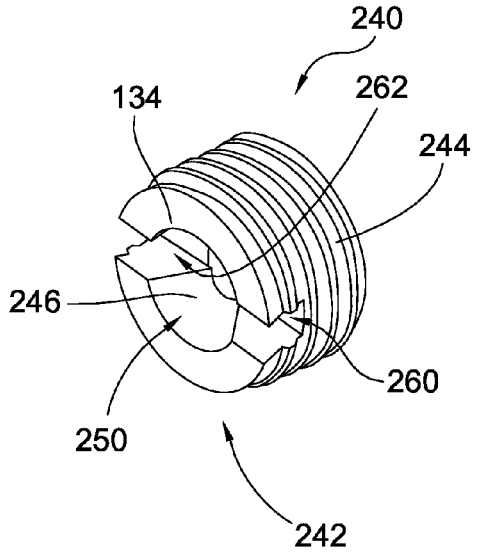
FIG. 7 is a perspective view of a muzzle brake plug.
Figure 8:
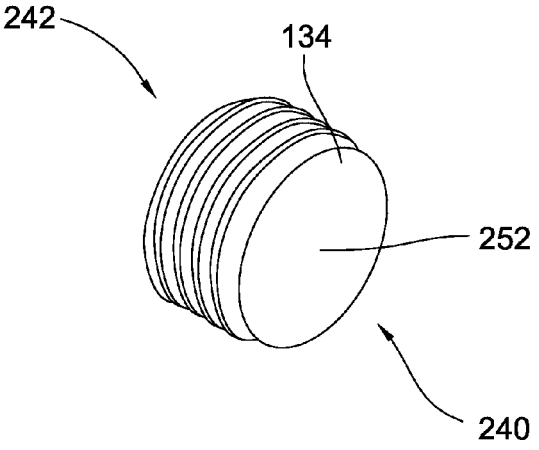
FIG. 8 is a perspective view of the muzzle brake plug of FIG. 7.
Figure 9:
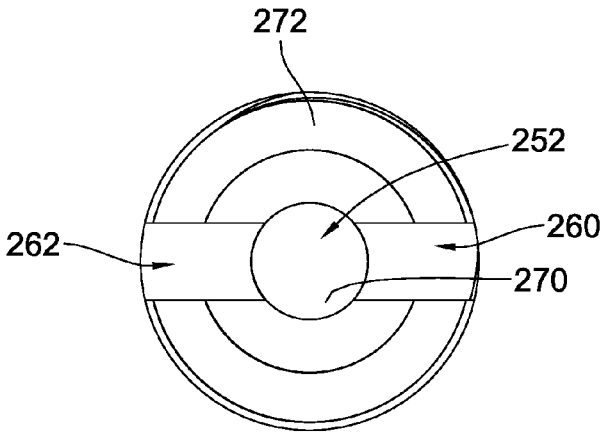
FIG. 9 is a top view of the muzzle brake plug of FIG. 7.
Figure 10:
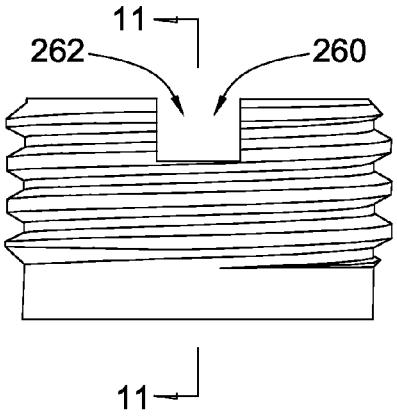
FIG. 10 is a side view of the muzzle brake plug of FIG. 7.
Figure 11:
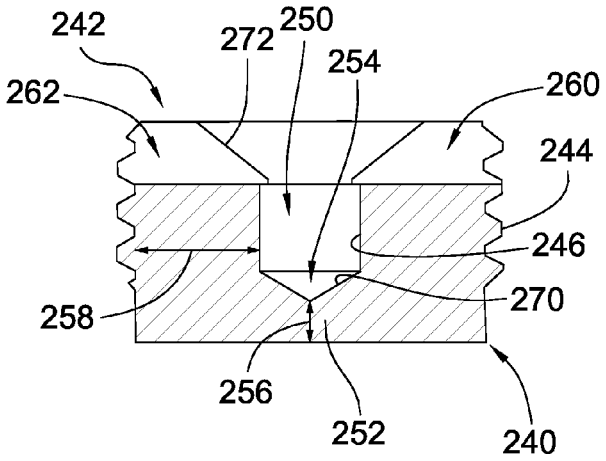
FIG. 11 is a cross-sectional view along line 11-11 of the muzzle brake plug of FIG. 10.

Muzzle brake body 150 also defines a second side port 180 and a third side port 190 (shown in FIG. 6). Similar to first side port 170, second side port 180 and third side port 190 each have a depth extending from central bore 160 towards an outer surface of muzzle brake body 150. Additionally, second side port 180 and third side port 190 extend transverse to central bore 160 and are also arranged to direct propellant gases from inside central bore 160 laterally to sides of muzzle brake 132. Second side port 180 and third side port 190 are also threaded side ports that can threadably receive muzzle brake plug 134.

Figure 4:
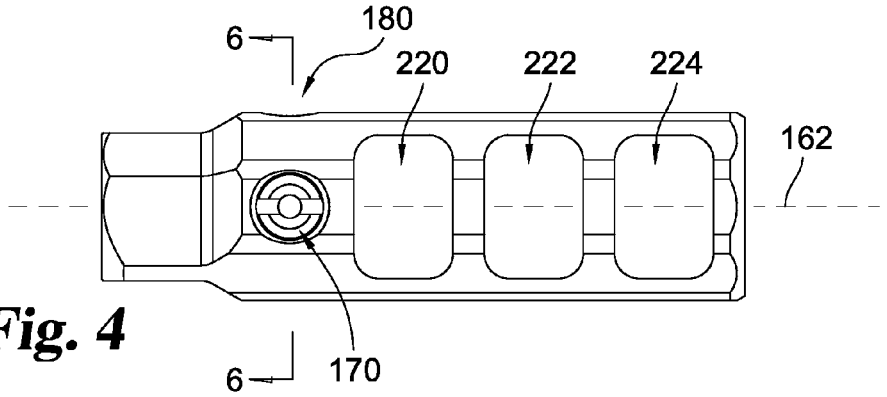
FIG. 4 is a side view of the muzzle brake of FIG. 2.
Figure 5:
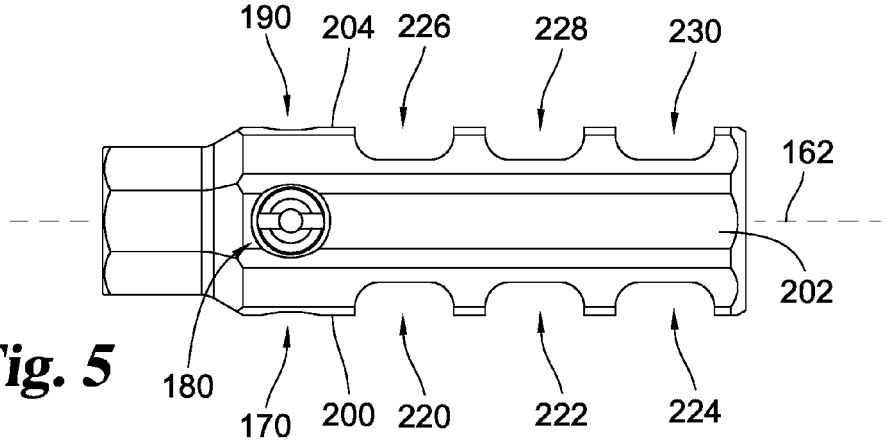
FIG. 5 is a top view of the muzzle brake of FIG. 4.

As shown in FIGS. 4, 5, and 6, the side ports of the plurality of side ports are spaced around the periphery of muzzle brake body 150 so that the side ports direct propellant gases from different sides of muzzle brake body 150 and in different directions away from muzzle brake body 150. In some instances, the side ports are asymmetrically spaced around the periphery of the muzzle brake body 150. For example, first side port 170 may extend to a first side 200 (e.g., the right side) of muzzle brake body 150, second side port 180 may extend to a second side 202 (e.g., the top side), and third side port 190 may extend to a third side 204 (e.g., the left side).

Additionally, first side port 170 may have a first longitudinal axis 210 that extends in a direction transverse to a second longitudinal axis 212 of second side port 180. Similarly, third side port 190 may have a third longitudinal axis 214 that extends transverse to at least one of first side port 170 and second side port 180. In many arrangements, first longitudinal axis 210 and second longitudinal axis 212 are perpendicular to one another when viewed along the length of central bore 160. Similarly, third longitudinal axis 214 may be perpendicular to second longitudinal axis 212 when viewed along the length of central bore 160 and/or parallel to or coincident with first longitudinal axis 210. However, one of ordinary skill in the art will appreciate that the longitudinal axes of the side ports can extend at any number of angles relative to each other.

In many instances, first longitudinal axis 210, second longitudinal axis 212, and third longitudinal axis 214 may extend along a single plane when viewed from a direction perpendicular to the longitudinal axis 162 of central bore 160. It is also contemplated, however, that side ports of the plurality of segments may be spaced along a portion of the length of muzzle brake body 150. For example, muzzle brake body 150 may include rows of side ports, with the side ports positioned in parallel planes that extend through muzzle brake body 150 and that are spaced along a length of the muzzle brake. Each row/plane may include a single side port or multiple side ports.

A muzzle brake plug 134 is positionable within each of the first, second, and third side ports. As will be discussed in more detail below, each muzzle brake plug 134 can have an interior surface defining a plug bore that extends at least partially through the thickness of the muzzle brake plug. When tuning a weapon system, a shooter may select a muzzle brake plug having a desired plug bore size (e.g., diameter and/or cross-sectional dimension) and/or may selectively modify a muzzle brake plug to have a desired plug bore size. The shooter may also insert muzzle brake plugs to selectively close one or more of the side ports of muzzle brake body 150. In this way, the muzzle brake can include a plurality of muzzle brake plugs, with the muzzle brake plugs having plug bores of different size.

In many instances, the muzzle brake will be arranged to vent propellant gases laterally away from the muzzle brake in an asymmetrical fashion. For instance, as illustrated in FIG. 6, muzzle brake plugs having a plug bore extending through the thickness of the muzzle brake plug are positioned with first side port 170 and second side port 180. Positioned within third side port 190 is a muzzle brake plug having a closed bottom, thereby closing third side port 190 and preventing the venting of propellant gases from third side 204. In this arrangement, the muzzle brake would vent propellant gases from the top and right side of the weapon system and thereby compensate the muzzle end of the weapon system in a downward and left direction when weapon is fired. This arrangement may be common for right-handed shooters. In many instances, one of the first side port 170 and third side port 190 will be closed with a muzzle brake plug with the other side port arranged to vent propellant gases.

Muzzle brake body 150 may also include at least one of a fourth side port 220, a fifth side port 222, a sixth side port 224, a seventh side port 226, an eighth side port 228, and a ninth side port 230. These side ports may be positioned forward of the first, second, and third side ports and, in many instances, are of a different size and/or shape than the first, second, and third side ports. For example, the side ports positioned forward of the first, second, and third side ports may be larger or smaller than the first, second, and third side ports. Additionally or alternatively, the fourth, fifth, sixth, seventh, eighth, and/or ninth side ports can be free of threads (e.g., smooth-wall side ports). The fourth, fifth, sixth, seventh, eighth, and ninth side ports in many instances extend from central bore 160 to the first side surface 200 and third side surface 204 of muzzle brake body 150.

An exemplary embodiment of muzzle brake plug 134 is illustrated in FIGS. 7-11. Muzzle brake plug 134 has a bottom end 240 and a top end 242 and a thickness extending from bottom end 240 to top end 242. Muzzle brake plug 134 also has an exterior surface 244 and an interior surface 246. Interior surface 246 defines a plug bore 250 that extends at least partially through the thickness of muzzle brake plug 134.

A bottom wall portion 252 of muzzle brake plug 134 closes a bottom end 254 of plug bore 250. Bottom wall portion 252, in many instances, has a thickness 256 less than the thickness 258 of a sidewall portion of muzzle brake plug 134.

Top end 232 of muzzle brake plug 134 defines a groove extending diametrically across top end 242 of muzzle brake plug 134 and having a first portion 260 and second portion 262. First and second portions 260, 262 of the groove are arranged to receive the end of a tool, such as a flat-head screw driver to allow a shooter to use a screwdriver to selectively insert or remove muzzle brake plug 134 from muzzle brake body 150. Top end 232 may include additional grooves to allow use of other tools, such as a Phillips-head screwdriver. Alternatively, or additionally, top end 232 may define a recess arranged to receive an end of an Allen wrench or a Torx bit and/or may have an outer surface arranged to be received within a wrench or gripped with pliers, such as a six-point hex head.

One or more portions of muzzle brake plug 134 may also include one or more tapered surfaces to aid in centering a drill bit positioned against muzzle brake plug 134. For example, bottom wall portion 252 that closes the bottom end of plug bore 250 may include a tapered surface 270 and top portion 232 of muzzle brake plug 134 may include tapered surface 272. Advantageously, one or more of these tapered surfaces can aid in centering a drill bit with plug bore 250.

Advantageously, the plug bore 250 and tapered surfaces can allow a user to quickly and easily drill through the bottom wall 252 of muzzle brake plug 134 to activate the port (i.e., allow propellant gases to escape from central bore 160) on either the left, right or top locations of muzzle brake 132. The side ports (e.g., the top, left, and/or right side ports) can be adjusted incrementally by drilling successively with larger drill bits until the firearm is tuned for the user and firearm system. Should the user drill a larger opening than desired through the plug bore, the muzzle brake plug can be removed from the muzzle brake and a replacement muzzle brake plug inserted into the side port.

In one exemplary method of tuning the firearm system, a shooter may fire a shot using the firearm system. Then, depending on the direction in which the muzzle end of the firearm recoiled or drifted, the shooter may selectively drill a larger opening in a muzzle brake plug located on the side of the muzzle brake towards which the firearm recoiled or drifted and/or replace a drilled muzzle brake plug on the opposing side of the muzzle brake with a muzzle brake plug having a smaller opening or no opening. For example, if after firing the firearm the muzzle end of the firearm drifted up and to the left (from the perspective of the shooter), the shooter may drill an opening or a larger opening in a muzzle brake plug positioned on the top of the muzzle brake and either drill an opening or larger opening in a muzzle brake plug positioned on the left of the muzzle brake and/or replace a drilled muzzle brake plug on the right side of the muzzle brake with a muzzle brake plug have a closed plug bore or a smaller opening to the plug bore. The shooter may then fire another shot using the firearm system and, if desired, repeat the process of drilling and/or replacing muzzle brake plugs to further refine the compensating forces of the muzzle brake.

The features and arrangement disclosed herein also allow a user to conveniently tune the muzzle brake should anything in the weapon system change, such as ammunition. Additionally, should the dynamics of the firearm be altered in an undesired fashion (e.g., the weapon fails to cycle properly) the user can simply replace one or more of the muzzle brake plugs and repeat the tuning process. Advantageously, the muzzle brake can be tuned without having to remove the entire muzzle brake, thus decreasing the amount of cost and time associated with making changes to the firearm system as well as easing the tuning process.

In certain competitive environments, it is not uncommon for shooters to use a variety of ammunition or to change the firearm configuration when being used for different purposes (e.g., close-range shooting vs. long-range shooting). These changes can hinder the effectiveness of a properly tuned muzzle brake, but with the present disclosure a shooter can simply swap out any number of plugs that have been tuned for each specific setup.

Devices of the present disclosure may be provided in a variety of arrangements. In some instances, a muzzle brake may be provided without muzzle brake plugs. It is also contemplated that muzzle brake plugs may be provided individually or in sets. Muzzle brake plugs having closed bottom may be provided, alternatively, a mixture of open and closed bottom muzzle brake plugs may be included. In some instances, a plurality of muzzle brake plugs having plug bores of different sizes (e.g., cross-sectional area) may be provided, allowing the user to select the desired plug bores/openings for the right, left, and top sides of the muzzle brake without needing to drill or punch out the closed bottom end of plug bores.

In some instances, a muzzle brake and muzzle brake plugs can be provided in a kit. The kit may additionally include one or more of the following: a barrel coupleable to or coupled to (e.g., received within) the rearward portion of the muzzle brake, an upper receiver attachable or attached to the barrel, and a bolt carrier group receivable within the upper receiver.

In some instances, the muzzle brake and/or muzzle brake plugs disclosed herein are provided as part of a weapons system (e.g., rifle or pistol). In certain arrangements, the muzzle brake is attached to a muzzle end of a firearm barrel to form a barrel assembly. The barrel assembly can, in turn, be part of an upper assembly including an upper receiver and a bolt carrier group. Furthermore, the upper assembly can be attached to a lower assembly that includes a lower receiver, a grip (e.g., a pistol grip), a trigger assembly and a buttstock and/or buffer tube.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A kit, comprising:

a muzzle brake, and a muzzle brake plug;

wherein the muzzle brake is arranged to couple to a muzzle end of a firearm barrel and defines a central bore and a first side port, the central bore extending through the muzzle brake and the first side port communicating with the central bore and the first side port arranged to replaceably receive the muzzle brake plug;

wherein the muzzle brake plug has an exterior surface, an interior surface and a thickness, the interior surface defining a plug bore that extends at least partially through the thickness of the muzzle brake plug;

wherein the first side port is a threaded side port and the muzzle brake plug is a threaded muzzle brake plug so that it may be threadably received within the threaded side port;

wherein the muzzle brake defines a second side port positioned forward of the first side port and communicating with the central bore of the muzzle brake; and wherein the second side port is free of threads.

2. The kit of claim 1, wherein:

the plug bore of the muzzle brake plug has a closed bottom.

3. The kit of claim 2, wherein:

the plug bore has a tapered bottom.

4. The kit of claim 2, wherein:

a top end of the muzzle brake plug has a taper towards the plug bore.

5. The kit of claim 1, wherein:

the muzzle brake plug has a groove extending diametrically across a top end of the muzzle brake plug.

6. The kit of claim 1, comprising:

a plurality of muzzle brake plugs.

7. The kit of claim 1, wherein:

the muzzle brake defines third and fourth side ports arranged to replaceably receive muzzle brake plugs; and wherein the first, third, and fourth side ports are positioned on the right, top, and left sides of the muzzle brake.

8. The kit of claim 1, wherein:

the second side port is larger than the first side port.

9. The kit of claim 1, comprising:

a firearm barrel receivable within the rearward portion of the muzzle brake.

10. The kit of claim 9, wherein:

the muzzle brake is pinned and welded to the end of the barrel.

11. The kit of claim 9, comprising:

an upper receiver attachable to the barrel; and a bolt carrier group receivable within the upper receiver.

12. A muzzle brake, comprising:

a muzzle brake body having a rearward portion and a forward portion and a length extending from the rearward portion to the forward portion;

wherein the rearward portion is arranged to couple to a muzzle end of a firearm barrel;

wherein the muzzle brake body defines a central bore and a plurality of side ports communicating with the central bore;

wherein the central bore extends through the length of the muzzle brake body;

wherein a first side port of the plurality of side ports is a threaded side port and is arranged to replaceably receive a threaded muzzle brake plug; and wherein side ports positioned forward of the first side port are larger or smaller than said first side port.

13. The muzzle brake of claim 12, wherein:

the plurality of side ports includes second and third side ports arranged to replaceably receive muzzle brake plugs; and wherein the first, second, and third side ports are positioned on the right, top, and left sides of the muzzle brake.

14. The muzzle brake of claim 12, wherein:

the side ports positioned forward of the first side port are free of threads.

15. A rifle, comprising:

an upper assembly; and a lower assembly;

the upper assembly including an upper receiver, a barrel assembly, and a bolt carrier group;

the lower assembly including a lower receiver, a grip, a trigger assembly, and a buttstock;

the barrel assembly including a barrel, a muzzle brake, and at least one muzzle brake plug;

wherein the muzzle brake is attached on a muzzle end of a firearm barrel and defines a central bore and a first side port, the central bore extending through the muzzle brake and the first side port communicating with the central bore and the first side port being threaded and arranged to replaceably receive the muzzle brake plug;

wherein the muzzle brake plug has a threaded exterior surface corresponding to the threaded first side port, an interior surface and a thickness, the interior surface defining a plug bore that extends at least partially through the thickness of the muzzle brake plug;

wherein the muzzle brake defines a second side port positioned forward of the first side port and communicating with the central bore of the muzzle brake; and wherein the second side port is free of a threaded surface.

16. The rifle of claim 15, wherein:

the plug bore of the muzzle brake plug has a closed bottom.

17. The rifle of claim 15, wherein:

the muzzle brake defines third and fourth threaded side ports arranged to replaceably receive muzzle brake plugs; and wherein the first, third, and fourth threaded side ports are positioned on the right, top, and left sides of the muzzle brake.

18. A kit, comprising:

a muzzle brake, and a muzzle brake plug;

wherein the muzzle brake is arranged to couple to a muzzle end of a firearm barrel and defines a central bore and a first side port, the central bore extending through the muzzle brake and the first side port communicating with the central bore and the first side port arranged to replaceably receive the muzzle brake plug;

wherein the muzzle brake plug has an exterior surface, an interior surface and a thickness, the interior surface defining a plug bore that extends at least partially through the thickness of the muzzle brake plug;

wherein the muzzle brake defines a second side port positioned forward of the first side port and communicating with the central bore of the muzzle brake; and wherein the second side port is larger than the first side port.

19. The muzzle brake of claim 12, wherein:

a plurality of side ports positioned forward of the first side port are larger than said first side port.

20. The rifle of claim 15, wherein:

the second side port is larger than the first side port.

* * * * *